United States Patent [19]

Wannop

[11] Patent Number: 5,058,463

[45] Date of Patent: Oct. 22, 1991

[54] RATCHET WRENCH WITH DUAL-ROTATING CONSTANT DRIVE HANDLE

[75] Inventor: George Wannop, Kelowna, Canada

[73] Assignee: Midland Design Inc., Kelowna, Canada

[21] Appl. No.: 605,236

[22] Filed: Oct. 29, 1990

[51] Int. Cl.[5] ..... B25B 17/00

[52] U.S. Cl. ..... 81/57.29; 81/57.26; 81/62; 81/58.1

[58] Field of Search ..... 81/57.29, 57.26, 58.1, 81/62–63.2

[56] References Cited

U.S. PATENT DOCUMENTS

| | | | |
|---|---|---|---|
| 2,316,243 | 4/1943 | Hubbard | 81/57.26 |
| 2,703,030 | 3/1955 | Marvin | 81/57.29 |
| 3,696,694 | 10/1972 | Boro | 81/57.29 X |
| 4,528,873 | 7/1985 | Lee | 81/57.29 |
| 4,545,267 | 10/1985 | Shumway | 81/57.29 |
| 4,592,256 | 6/1986 | Bosque | 81/57.29 |
| 4,800,785 | 1/1989 | Christensen | 81/57.29 |

FOREIGN PATENT DOCUMENTS

| | | | |
|---|---|---|---|
| 878432 | 10/1942 | France | 81/57.29 |

*Primary Examiner*—James G. Smith
*Attorney, Agent, or Firm*—Barrigar & Oyen

[57] ABSTRACT

A ratchet wrench having a handle through which a rotatable shaft extends. A bevel gear is coupled to one end of the shaft for rotation by the shaft about an input drive axis. A pair of concentrically aligned ring gears are coupled to the bevel gear for counter rotation of the ring gears, by the bevel gear, about an output drive axis perpendicular to the input drive axis. A drive member is mounted inside the ring gears for rotation about the output drive axis. A ratchet mechanism couples the ring gears to the drive member such that, for either direction of rotation of the bevel gear, one of the ring gears is coupled to the drive member and the other of the ring gears is decoupled from the drive member. The ring gears are further coupled to the bevel gear for unidirectional rotation of the ring gears about the output drive axis in response to pivotal movement of the handle about the output drive axis. The ratchet mechanism additionally couples the ring gears to the drive member such that, upon such unidirectional rotation of the ring gears about the output drive axis, both of the ring gears are coupled to the drive member.

17 Claims, 4 Drawing Sheets

RATCHET WRENCH WITH DUAL-ROTATING CONSTANT DRIVE HANDLE

FIELD OF THE INVENTION

This application pertains to a ratchet wrench having a handle which may be rotated in either direction about its longitudinal axis to produce continuous, unidirectional rotation of a fastener drive member.

BACKGROUND OF THE INVENTION

Conventional ratchet wrenches employ a fixed handle coupled to a ratchet mechanism. A fastener drive member projects from the ratchet mechanism, perpendicular to the handle. The ratchet mechanism allows the handle to swing through a plane perpendicular to the drive member. A two position switch on the ratchet mechanism governs the direction of rotation of the drive member. When the switch is in one position, the ratchet mechanism couples the handle to the drive member such that clockwise swinging of the handle causes corresponding clockwise rotation of the drive member. When the handle is swung counter-clockwise, the ratchet mechanism "ratchets" by decoupling the handle from the drive member, to prevent counter-clockwise rotation of the drive member. Conversely, when the switch is in the other position, the ratchet mechanism couples the handle to the drive member such that clockwise swinging of the handle causes the ratchet mechanism to "ratchet" by decoupling the handle from the drive member, preventing clockwise rotation of the drive member; whereas counter-clockwise swinging of the handle results in the ratchet mechanism coupling the handle to the drive member to cause corresponding counter-clockwise rotation of the drive member.

Problems arise if a conventional ratchet wrench must be used in cramped quarters. For example, a bolt may be recessed in such a manner that, when a socket mounted on the drive member is positioned over the bolt, the wrench handle may only be swung through a limited arc. This necessitates excessive back and forth swinging of the wrench handle, and may prevent the application of sufficient force to loosen the bolt or tighten it adequately.

A further problem with the conventional ratchet wrench is that loose nuts and bolts may not offer sufficient resistance to cause the ratchet mechanism to ratchet. It thus becomes necessary to hand thread loose nuts and bolts until they are secured sufficiently to present adequate resistance to the ratchet mechanism, or to complete their removal by hand. Even if a loose nut or bolt appears to offer sufficient resistance to cause the ratchet mechanism to ratchet, the resistance may be intermittent, such that excessive back and forth swinging of the wrench handle is required to tighten or complete the removal of the nut or bolt.

The prior art has addressed the foregoing problems in a variety of ways. For example, U.S. Pat. No. 2,703,030 issued to Marvin for an invention entitled "Gear Operated Ratchet Wrench" employs a rotatable shaft which extends through the wrench handle. Gears couple one end of the shaft to the fastener drive member. A folding handle extension is coupled to the other end of the shaft. The handle extension may be unfolded and manipulated to rotate the shaft, thus rotating the fastener drive member. U.S. Pat. No. 4,262,561 issued to Mize for an invention entitled "Ratchet and Gear Drive Socket Wrench Handle" provides a structure similar to that of Marvin. Mize however employs a removable "bit and brace" type handle extension which may be attached to the end of a rotatable shaft extending through the conventional wrench: handle and coupled to the fastener drive member and. Mize' "bit and brace" type handle may be manipulated to rotate the shaft, thus rotating the fastener drive member. U.S. Pat. No. 4,680,994 issued to Singleton for an invention entitled "Socket Wrench With Reversing Ratchet" provides another structure similar to that of Marvin. A T-shaped handle extension protrudes from the end of the conventional wrench handle. The T-shaped handle extension is coupled to one end of a rotatable shaft which extends through the conventional wrench handle and is coupled, at its other end, to the fastener drive member. Rotation of the T-shaped handle extension rotates the shaft, which in turn rotates the fastener drive member.

Another prior art device provides a handle extension which extends at an angle alongside the conventional wrench handle. The extension may be squeezed against the conventional handle. This action is said to actuate a cam and link mechanism which in turn rotates the fastener drive member.

The foregoing prior art devices have some limitations. The handle extensions which they employ are comparatively bulky, which may defeat the objective of working in cramped quarters. Also, they appear to employ ratchet mechanisms which are functionally equivalent to the ratchet mechanism of the above-described conventional ratchet wrench. The present invention, by contrast, facilitates working in cramped quarters, threading or unthreading of loose nuts and bolts, etc. without a handle extension. Moreover, the present invention provides a unique ratchet mechanism which allows the fastener drive member to be continually rotated in one direction via clockwise and/or counterclockwise rotation of the wrench handle about its longitudinal axis.

SUMMARY OF THE INVENTION

In accordance with the preferred embodiment, the invention provides a ratchet wrench having a handle through which a rotatable shaft extends. A first drive means is coupled to the shaft for rotation by the shaft about an input drive axis. Second and third drive means are coupled to the first drive means for counter rotation of the second and third drive means, by the first drive means, about an output drive axis perpendicular to the input drive axis. A drive member is provided for rotation about the output drive axis. Ratchet means couple the second and third drive means to the drive member such that, for either direction of rotation of the first drive means, one of the second and third drive means is coupled to the drive member and the other of the second and third drive means: is decoupled from the drive member.

The second and third drive means are further coupled to the first drive means for unidirectional rotation of the second and third drive means about the output drive axis in response to pivotal movement of the handle about the output drive axis.

The ratchet means also couples the second and third drive means to the drive member such that, upon unidirectional rotation of the second and third drive means as aforesaid, both of the second and third drive means are coupled to the drive member for one direction of rotation about the output drive axis, and both of the second and third drive means are decoupled from the drive member for the opposite direction of rotation about the output drive axis.

Preferably, the first drive means is a bevel gear and the second and third drive means are ring gears. Advantageously, the ring gears are concentrically aligned and have internally splined cylindrical apertures.

The ratchet means may comprise a drive block rotatably mounted within the ring gears' concentrically aligned apertures, a first pawl pivotally mounted in the drive block for ratcheting engagement with the splined aperture of one of the ring gears, and a second pawl pivotally mounted in the drive block for ratcheting engagement with the splined aperture of the other ring gear.

A selector means is provided for selecting a direction of rotation of the drive member about the drive axis. The selector means preferably comprises a selector shaft extending through the drive block, a two position switch on one end of the selector shaft, and first and second pins protruding from the selector shaft to respectively urge the first and second pawls toward the respective ring gears. Placement of the switch in one position rotates the selector shaft to position the pins adjacent first ends of the respective pawls. Placement of the switch in the other position rotates the selector shaft to position the pins adjacent the opposite ends of the respective pawls.

A rotatable grip is preferably fixed on one end of the shaft opposite the first drive means. The grip may encircle a portion of the handle.

DETAILED DESCRIPTION OF THE PREFERRED EMBODIMENT

Figure 1:
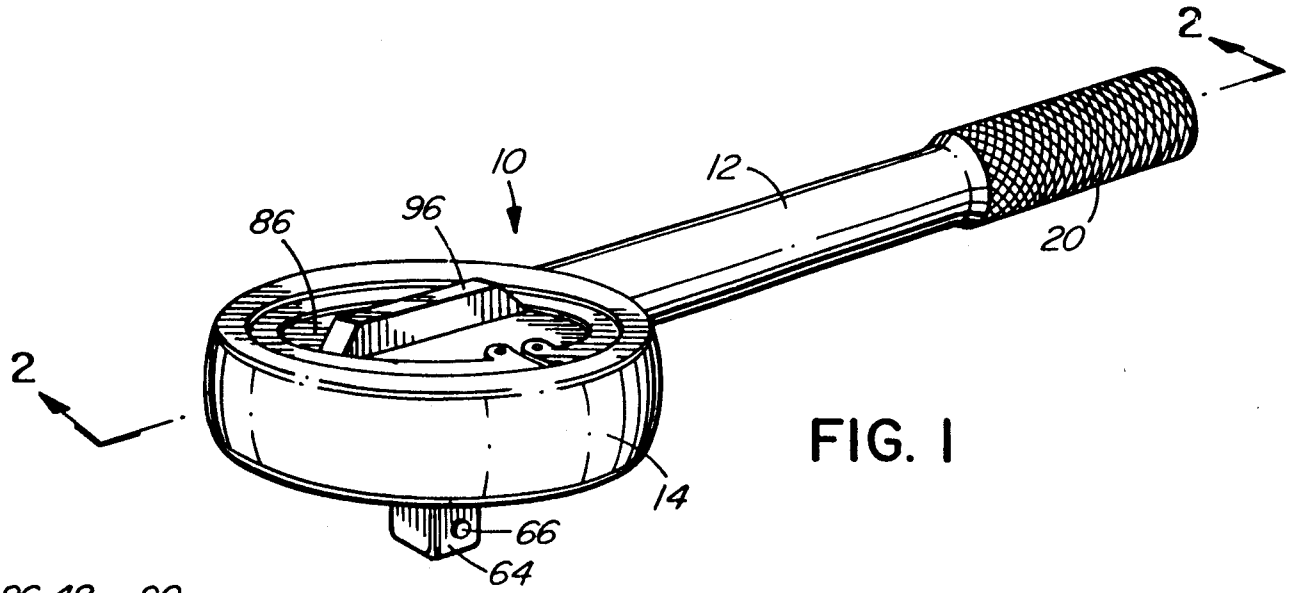
FIG. 1 is an oblique pictorial illustration of a ratchet wrench constructed in accordance with the preferred embodiment of the invention.
Figure 2:
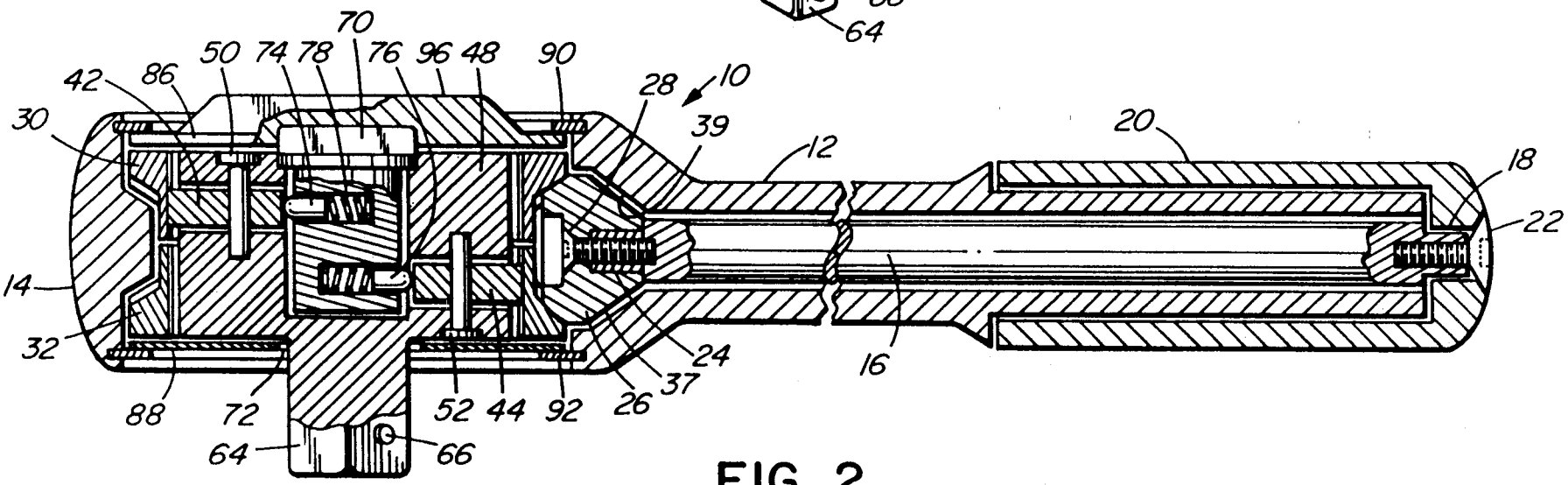
FIG. 2 is a partially fragmented, cross-sectional side elevation view taken with respect to line 2—2 of FIG. 1.
Figure 3:
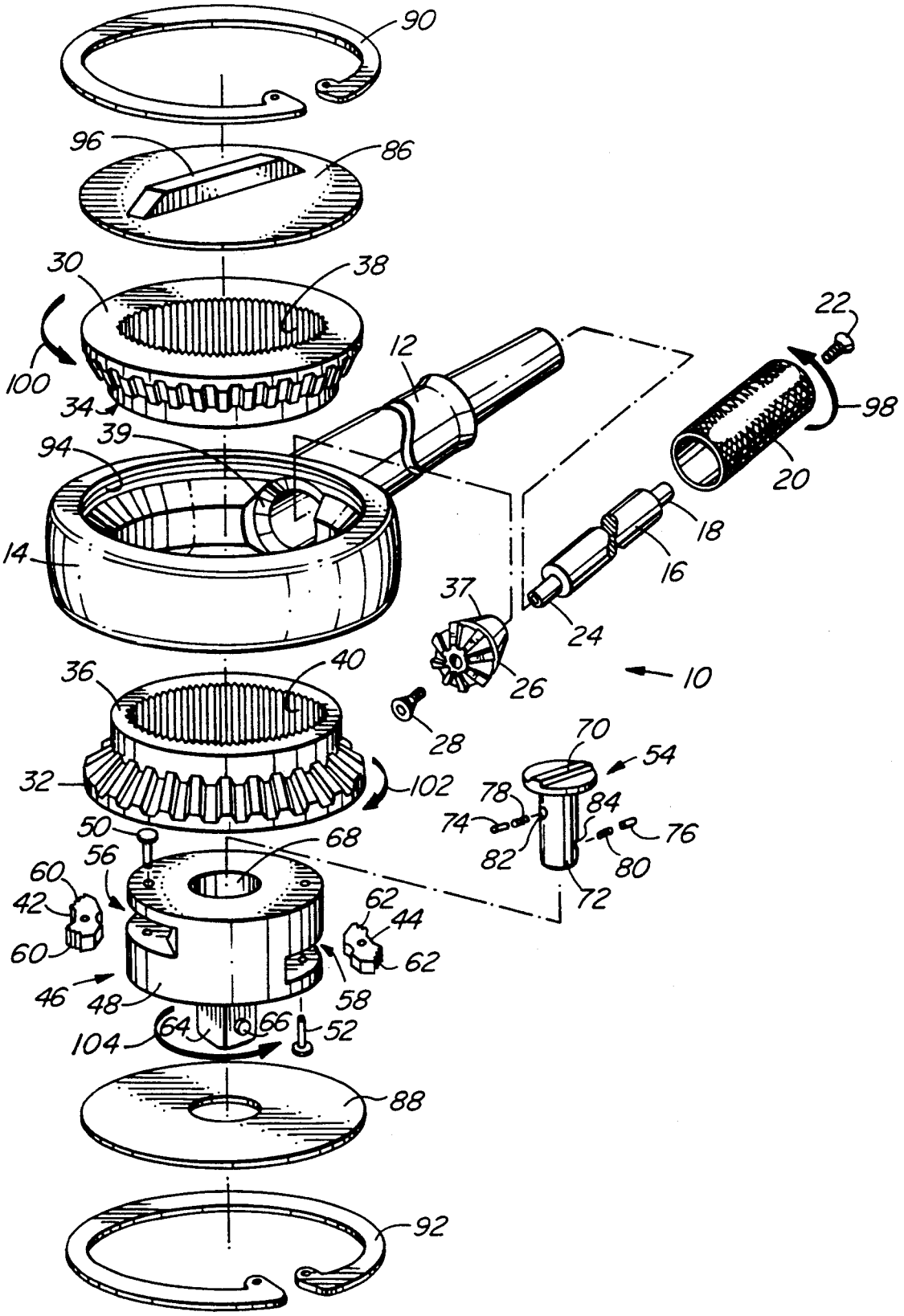
FIG. 3 is an exploded pictorial illustration of the wrench of FIG. 1.

As depicted in FIGS. 1, 2 and 3, wrench 10 incorporates a handle 12 fixed to a casing 14 which encloses a gear drive and ratchet assembly as hereinafter described. A rotatable shaft 16 projects through handle 12 into casing 14. A squared projection 18 on the end of shaft 16 fits snugly within a mating recess in sleeve 20, which is fastened to shaft 16 with screw 22, such that sleeve 20 encircles a portion of handle 12. Another squared projection 24 on the opposite end of shaft 16 fits snugly within a mating recess in a "first drive means" or bevel gear 26, which is fastened to shaft 16 with screw 28. It will thus be understood that sleeve 20 may be rotated either clockwise or counter-clockwise around handle 12, and that such rotation will cause corresponding clockwise or counter-clockwise rotation of shaft 16 and gear 26 about an "input drive axis" which, in the case of the embodiment illustrated in FIGS. 1, 2 and 3, is the longitudinal axis of shaft 16.

As best seen in FIG. 2, gear 26 is positioned, within casing 14, to simultaneously mesh with the outer toothed surfaces of second and third ring gears 30, 32 which respectively constitute "second and third drive means" positioned within casing 14 with their rims 34, 36 concentrically aligned against one another to act as bearing surfaces. The adjacent surfaces 37, 39 of gear 26 and casing 14 are preferably tapered and machined to provide a bearing surface for absorbing forces imparted to gear 26 during use of wrench 10. The inner surfaces 38, 40 of ring gears 30, 32 are toothed or splined for ratchetable engagement with pawls 42, 44 as hereinafter explained.

A reversible ratchet assembly 46 comprising drive block 48; pawls 42, 44; pins 50, 52 and selector switch assembly 54 is rotatably mounted within the concentrically aligned cylindrical apertures of ring gears 30, 32. Drive block 48 is provided with upper and lower recesses 56, 58. Pins 50, 52 pivotally fasten pawls 42, 44 within recesses 56, 58 respectively such that the pawls' toothed outer portions 60, 62 are respectively positioned for ratchetable engagement with splined inner surfaces 38, 40 of ring gears 30, 32. A conventional fastener drive member 64 having a spring-loaded ball 66 is fixed to drive block 48 for coupling to a conventional drive socket or other fastener.

Selector switch assembly 54 fits within a cylindrical aperture 68 in drive block 48, opposite fastener drive member 64. Selector switch assembly 54 is made up of cap 70, shaft 72, pins 74, 76 and springs 78, 80. Spring 78 is compressed, by pin 74, within an upper aperture 82 in shaft 72 such that pin 74 protrudes from shaft 72 in alignment with pawl 42. Spring 80 is similarly compressed, by pin 76, within a lower aperture 84 in shaft 72 such that pin 76 protrudes from shaft 72 in alignment with pawl 44. Cap 70 is positioned to select clockwise or counter-clockwise rotation of drive member 64, as hereinafter explained. In either position, pins 74, 76 are forced, by springs 78, 80 against one or the other of the inwardly facing ends of pawls 42, 44.

Upper and lower cover plates 86, 88 hold ring gears 30, 32 and ratchet assembly 46 in place within casing 14 and act as bearing surfaces for the outwardly facing portions of ring gears 30, 32 and drive block 48. Spring retaining clips 90, 92 are in turn provided to hold cover plates 86, 88 in place. Clips 90, 92 respectively fit within recesses provided around the upper and lower internal edges of casing 14. Only the upper recess 94 is visible in FIG. 3. Upper cover plate 86 has a protrusion 96 sized to fit snugly over a mating projection on selector switch cap 70 such that rotation of protrusion 96 causes corresponding rotation of cap 70 and selector switch shaft 72.

In operation, a socket or other fastener is removably attached to fastener drive member 64, in conventional fashion. Wrench 10 may then be used in conventional fashion by positioning the socket over a nut or bolt and swinging handle 12 clockwise or counter-clockwise about an "output drive axis"; namely, the longitudinal axis of drive member 64. The user perceives wrench 10 to operate in conventional fashion. That is, depending upon the position of selector switch cap 70, ratchet assembly 46 couples handle 12 to drive member 64 such that clockwise swinging of handle 12 causes corresponding clockwise rotation of drive member 64. When handle 12 is swung counter-clockwise, ratchet assembly 46 decouples handle 12 from drive member 64, to prevent counter-clockwise rotation of drive member 64. Conversely, when selector switch cap 70 is in the other position, ratchet assembly 46 couples handle 12 to drive member 64 such that clockwise swinging of handle 12 causes ratchet assembly to decouple handle 12 from drive member 64, preventing clockwise rotation of drive member 64; whereas counter-clockwise swinging of handle 12 results in ratchet assembly 46 coupling handle 12 to drive member 64 to cause corresponding counter-clockwise rotation of drive member 64. The internal operation of ratchet assembly 46 is described below.

Wrench 10 may also be used in non-conventional fashion by positioning the socket over a nut or bolt and rotating (i.e. twisting) sleeve 20 clockwise and/or counter-clockwise about the longitudinal axis of sleeve 20. Rotation of sleeve 20 in either direction causes drive member 64 to rotate in a single direction governed by the position of selector switch cap 70. Thus, the user may grip sleeve 20 and, without loosening that grip, twist sleeve 20 rapidly back and forth about the longitudinal axis of sleeve 20. Such bi-directional twisting is converted, by ratchet assembly 46, to unidirectional rotation of drive member 64. Accordingly, even in cramped quarters where handle 12 cannot be swung, wrench 10 may still be operated in a manner which facilitates continual, rapid unidirectional rotation of drive member 64.

The internal operation of ratchet assembly 46 will now be described. Consider first the non-conventional operation of wrench 10 in which sleeve 20 is rotated (i.e. twisted) clockwise and/or counter-clockwise about the longitudinal axis of sleeve 20. As previously mentioned, clockwise rotation of sleeve 20 (i.e. in the direction of arrow 98 shown in FIG. 3) causes corresponding clockwise rotation of shaft: 16 and gear 26, which in turn causes ring gears 30, 32 to respectively counter-rotate in the direction of arrows 100, 102 shown in FIG. 3.

Assume that selector switch cap 70 has been positioned for rotation of drive member 64 in the direction of arrow 104 shown in FIG. 3. This means that pin 74 is forced, by spring 78, against one of the inwardly facing ends of pawl 42, such that teeth 60 on the opposite outwardly facing end of pawl 42 catch the splined inner surface 38 of ring gear 30 as ring gear 30 rotates in one direction; and, such that pawl 42 ratchets as ring gear 30 rotates in the other direction. Similarly, pin 76 is forced, by spring 80, against one of the inwardly facing ends of pawl 44, such that teeth 62 on the opposite outwardly facing end of pawl 44 catch the splined inner surface 40 of ring gear 32 as ring gear 32 rotates in one direction; and, such that pawl 44 ratchets as ring gear 32 rotates in the other direction. More particularly, counter-rotation of ring gears 30, 32 in the direction of arrows 100, 102 causes pawl 44 to ratchet as aforesaid, while pawl 42 catches ring gear 30, causing drive block 48 to rotate in the direction of arrow 104.

Conversely, counter-clockwise rotation of sleeve 20 (i.e. in the direction opposite to arrow 98) causes corresponding counter-clockwise rotation of shaft 16 and gear 26, which in turn causes ring gears 30, 32 to counter-rotate in directions opposite to arrows 100, 102. Again assuming selector switch cap 70 to be positioned for rotation of drive member 64 in the direction of arrow 104, pawl 42 now ratchets with respect to ring gear 30, while pawl 44 catches ring gear 32, causing drive block 48 to rotate in the direction opposite to arrow 102 (i.e. in the direction of arrow 104). It will thus be understood that, so long as selector switch cap 70 remains positioned for rotation of drive member 64 in the direction of arrow 104, clockwise or counter-clockwise rotation of sleeve 20 causes drive member 64 to rotate the direction of arrow 104. If selector switch cap 70 is re-positioned, for rotation of drive member 64 in the direction opposite to arrow 104, then the operation is the same, the only difference being that pins 74, 76 are now positioned to cause the opposite catching and ratcheting of pawls 42, 44 to that described above.

Now consider the conventional operation of wrench 10 in which handle 12 is swung clockwise or counter-clockwise about the output drive axis (i.e. the longitudinal axis of drive member 64). Assume that selector switch cap 70 has been positioned for rotation of drive member 64 in the direction of arrow 104 shown in FIG. 3. While handle 12 is swung in the direction of arrow 104, sleeve 20 is held relatively stationary, so shaft 16 and gear 26 remain stationary. The torque applied to handle 12 thus acts through gear 26 to rotate both ring gears 30, 32 in the same direction (i.e. in the direction of arrow 104). Accordingly, pawls 42, 44 both catch on the ring gears' splined inner surfaces 38, 40 and both pawls act in unison to rotate drive block 48 in the direction of arrow 104. If handle 12 is now swung in the direction opposite to arrow 104, gear 26 again rotates both ring gears 30, 32 in the same direction (i.e. in the direction opposite to arrow 104). Accordingly, pawls 42, 44 both ratchet with respect to the ring gears' splined inner surfaces 38, 40 and no rotational drive is imparted to drive block 48. If selector switch cap 70 is re-positioned, for rotation of drive member 64 in the direction opposite to arrow 104, then the operation is the same, the only difference being that pins 74, 76 are now positioned to cause the opposite catching and ratcheting of pawls 42, 44 to that described above. It will be noted that, when wrench 10 is operated in conventional fashion, force is transmitted from handle 12 to drive block 48 through both ring gears 30, 32. This distributes the force over two sets of gear teeth and minimizes torsional forces on handle 12.

Figure 4:
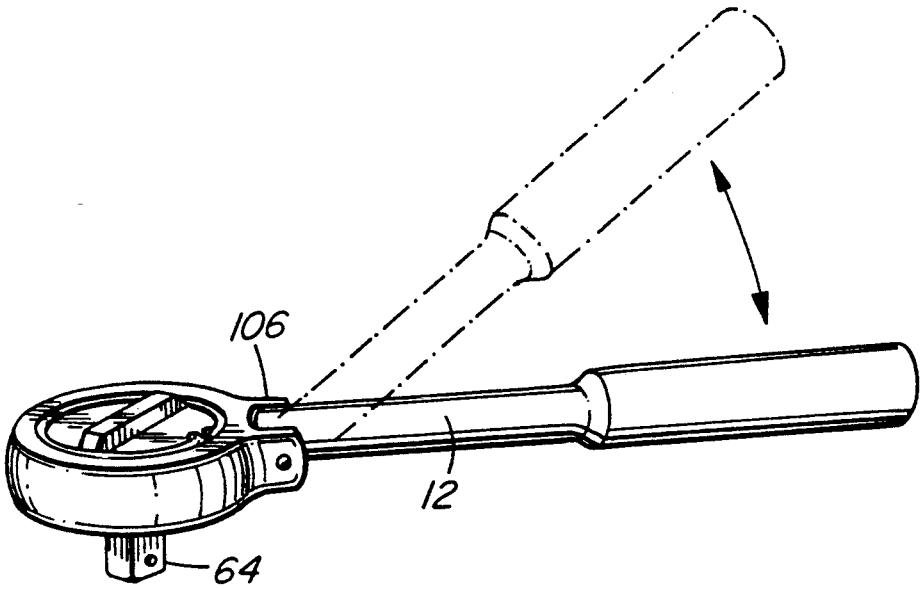
FIG. 4 is a pictorial illustration of an alternative embodiment of the invention having a pivotable handle.

As will be apparent to those skilled in the art in the light of the foregoing disclosure, many alterations and modifications are possible in the practice of this invention without departing from the spirit or scope thereof. For example, the "first drive means" (i.e. bevel gear 26) need not be fixed to shaft 16 as depicted in FIGS. 1, 2 and 3. Instead, as depicted in FIG. 4, a universal joint type coupling 106 may be interposed between shaft 16 and gear 26. This allows handle 12 to pivot as illustrated in FIG. 4, facilitating use of the invention in situations where a fixed handle cannot be employed due to space limitations in the region surrounding the nut, bolt or other fastener which is to be tightened or loosened. Note that in this embodiment, as the handle pivots, the "input drive axis" does not always coincide with the longitudinal axis of shaft 16, but passes through the center of universal joint type coupling 106, perpendicular to the output drive axis about which drive member 64 rotates.

Figure 5:
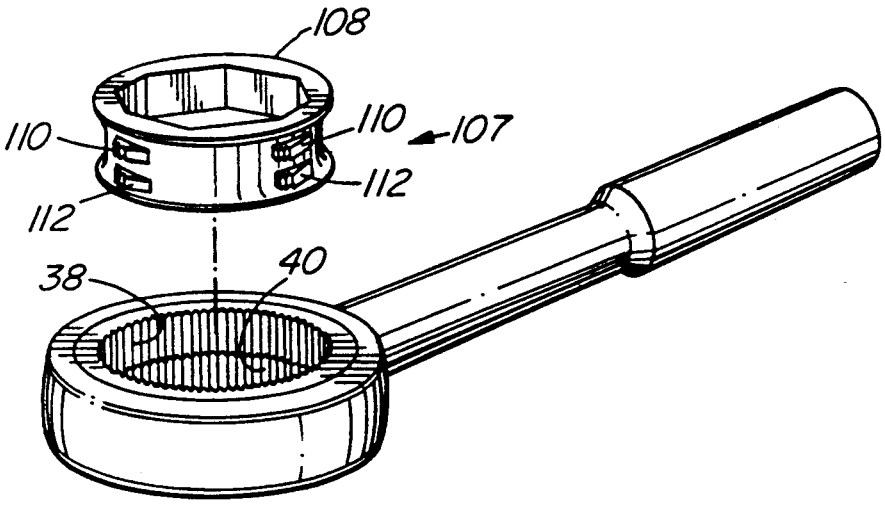
FIG. 5 is an oblique pictorial illustration of a box wrench adaptation of the invention.

As another example, FIG. 5 illustrates how the invention may be configured as a box wrench 107 by replacing ratchet assembly 46 and selector switch assembly 54 with a box wrench head 108 carrying fixed unidirectional pawls 110, 112 on its outer surface for mating engagement with the splined inner surfaces 38, 40 of ring gears 30, 32. No rotational direction selector is required, since box wrench 107 may be flipped 180° to obtain the opposite direction of rotation. The box wrench and socket drive heads could be made to snap into place for rapid interchange.

Figure 6:
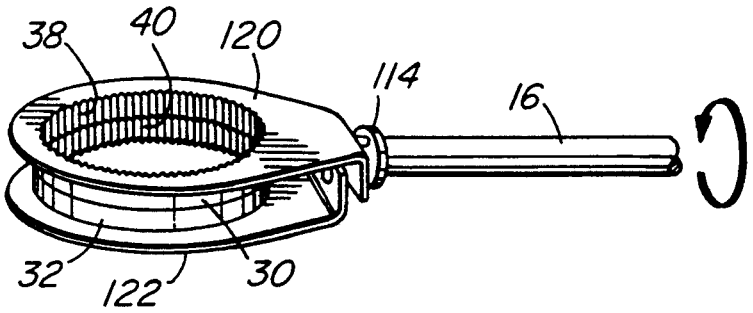
FIGS. 6 and 7 are respectively oblique pictorial and side elevation views of an air drive adaptation of the invention.
Figure 7:
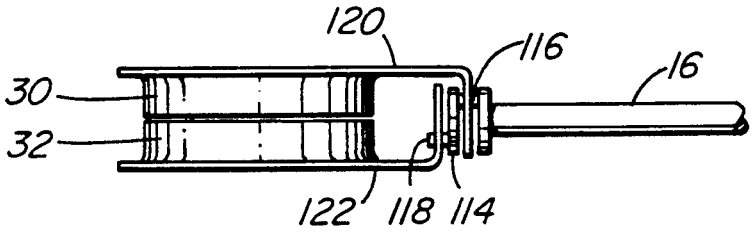

As a further example, FIGS. 6 and 7 illustrate how the invention may be adapted for use with an air drive mechanism by replacing gear 26 with a dual crank mechanism 114. This would eliminate slippage problems encountered when conventional air drive ratchet wrenches are used on bolts mounted in rubber or similar springy material. A springy mount may cause the bolt to slip or spring back (i.e. in the direction opposite to that in which it is desired to drive the bolt) before the next tooth of the ratchet mechanism can engage, defeating attempts to tighten or loosen the bolt. Dual crank mechanism 114 has two arms 116, 118, each corresponding to the single offset pin found in a conventional air drive ratchet wrench. Arms 116, 118 are respectively coupled, by brackets 120, 122, to ring gears 30, 32. Rotation of shaft 16 causes arms 116, 118 to oscillate rapidly back and forth at their points of coupling to brackets 120, 122. A drive force is thus always imparted to one of the ring gears, while the other ring gear ratchets. Continual unidirectional drive is thus achieved, in contrast to the oscillating on/off drive characteristic of conventional air drive ratchet wrenches which suffer slippage as aforesaid.

Accordingly, the scope of the invention is to be construed in accordance with the substance defined by the following claims.

I claim:

1. A ratchet wrench, comprising:

(a) a handle;

(b) a rotatable shaft extending through said handle;

(c) first drive means coupled to said shaft for rotation by said shaft about an input drive axis;

(d) second and third drive means coupled to said first drive means for counter rotation of said second and third drive means, by said first drive means, about an output drive axis perpendicular to said input drive axis;

(e) a drive member rotatable about said output drive axis; and, (f) ratchet means for coupling said second and third drive means to said drive member such that, for either direction of rotation of said first drive means, one of said second and third drive means is coupled to said drive member and the other of said second and third drive means is decoupled from said drive member.

2. A ratchet wrench as defined in claim 1, wherein said second and third drive means are further coupled to said first drive means for unidirectional rotation of said second and third drive means about said output drive axis in response to pivotal movement of said handle about said output drive axis.

3. A ratchet wrench as defined in claim 2, wherein said ratchet means is further for coupling said second and third drive means to said drive member such that, upon said unidirectional rotation of said second and third drive means about said output drive axis, both of said second and third drive means are coupled to said drive member for one direction of rotation about said output drive axis, and both of said second and third drive means are decoupled from said drive member for the opposite direction of rotation about said output drive axis.

4. A ratchet wrench as defined in claim 3, wherein said second and third drive means are ring gears.

5. A ratchet wrench as defined in claim 4, wherein said ring gears further comprise concentrically aligned, internally splined cylindrical apertures.

6. A ratchet wrench as defined in claim 5, wherein said ratchet means further comprises:

(a) a drive block rotatably mounted within said concentrically aligned apertures;

(b) a first pawl pivotally mounted on said drive block for ratcheting engagement with said splined aperture of one of said ring gears; and, (c) a second pawl pivotally mounted on said drive block for ratcheting engagement with said splined aperture of the other of said ring gears.

7. A ratchet wrench as defined in claim 6, further comprising selector means for selecting a direction of rotation of said drive member about said output drive axis.

8. A ratchet wrench as defined in claim 7, wherein said selector means comprises:

(a) a selector shaft extending through said drive block;

(b) a two position switch on one end of said selector shaft; and, (c) first and second pins protruding from said selector shaft to respectively urge said first and second pawls toward said respective ring gears;

whereby placement of said switch in one position rotates said selector shaft to position said pins adjacent first ends of said respective pawls and placement of said switch in the other position rotates said selector shaft to position said pins adjacent the opposite ends of said respective pawls.

9. A ratchet wrench as defined in claim 8, further comprising a rotatable grip fixed on one end of said shaft opposite said first drive means.

10. A ratchet wrench as defined in claim 9, wherein said grip encircles a portion of said handle.

11. A ratchet wrench, comprising:

(a) a handle;

(b) a rotatable shaft extending through said handle;

(c) a rotatable grip fixed on one end of said shaft;

(d) a bevel gear fixed to the opposite end of said shaft for rotation about the longitudinal axis of said shaft;

(e) first and second concentrically aligned ring gears coupled to said bevel gear for counter rotation of said ring gears, by said bevel gear, about an output drive axis perpendicular to said shaft;

(f) a drive member rotatable about said output drive axis; and, (g) reversible ratchet means for coupling said ring gears to said drive member such that, for either direction of rotation of said bevel gear, one of said ring gears is coupled to said drive member and the other of said ring gears is decoupled from said drive member.

12. A ratchet wrench as defined in claim 11, wherein said ring gears are further coupled to said bevel gear for unidirectional rotation of said ring gears about said output drive axis in response to pivotal movement of said handle about said output drive axis.

13. A ratchet wrench as defined in claim 12, wherein said ratchet means is further for coupling said ring gears to said drive member such that, upon said unidirectional rotation of said ring gears about said output drive axis, both of said ring gears are coupled to said drive member.

14. A ratchet wrench as defined in claim 13, wherein said ring gears further comprise internally splined cylindrical apertures.

15. A ratchet wrench as defined in claim 14, wherein said ratchet means further comprises:

(a) a drive block rotatably mounted within said concentrically aligned apertures;

(b) a first pawl pivotally mounted in said drive block for ratcheting engagement with said splined aperture of one of said ring gears; and, (c) a second pawl pivotally mounted in said drive block for ratcheting engagement with said splined aperture of the other of said ring gears.

16. A ratchet wrench as defined in claim 15, further comprising selector means for selecting a direction of rotation of said drive member about said output drive axis.

17. A ratchet wrench as defined in claim 16, wherein said selector means comprises:

(a) a selector shaft extending through said drive block;

(b) a two position switch on one end of said selector shaft; and, (c) first and second pins protruding from said selector shaft to respectively urge said first and second pawls toward said respective ring gears;

whereby placement of said switch in one position rotates said shaft to position said pins adjacent first ends of said respective pawls and placement of said switch in the other position rotates said shaft to position said pins adjacent the opposite ends of said respective pawls.

* * * * *